US005421443A

United States Patent [19]

Hatamachi et al.

[11] Patent Number: 5,421,443

[45] Date of Patent: Jun. 6, 1995

[54] BILL PROCESSING UNIT

[75] Inventors: Tadashi Hatamachi, Tsurugashima; Makoto Yamamoto, Sayama; Mitsugu Mikami, Kawagoe, all of Japan

[73] Assignee: Kabushiki Kaisha Nippon Conlux, Japan

[21] Appl. No.: 343,834

[22] Filed: Nov. 22, 1994

Related U.S. Application Data

[63] Continuation of Ser. No. 147,328, Nov. 3, 1993, abandoned.

[30] Foreign Application Priority Data

Nov. 5, 1992 [JP] Japan ..... 4-296009

[51] Int. Cl.[6] ..... G07F 7/04

[52] U.S. Cl. ..... 194/206; 194/207; 271/180

[58] Field of Search ..... 194/206, 207; 271/177, 271/180, 181

[56] References Cited

U.S. PATENT DOCUMENTS

| | | | |
|---|---|---|---|
| 4,011,931 | 3/1977 | Wyckoff | 194/206 |
| 4,540,081 | 9/1985 | Mori et al. . | |
| 4,556,139 | 12/1985 | Akagawa et al. . | |
| 4,678,072 | 7/1987 | Kobayashi et al. . | |
| 4,765,607 | 8/1988 | Zouzoulas | 271/177 |
| 4,784,274 | 11/1988 | Mori et al. . | |
| 4,809,966 | 3/1989 | Kobayashi et al. | 194/206 X |
| 5,005,688 | 4/1991 | Yukimoto et al. . | |
| 5,195,739 | 3/1993 | Watabe | 271/181 X |

FOREIGN PATENT DOCUMENTS

| | | | |
|---|---|---|---|
| 55-37466 | 9/1980 | Japan . | |
| 63-252870 | 10/1988 | Japan | 271/180 |
| 2183390 | 7/1990 | Japan | 194/207 |
| 3-46955 | 2/1991 | Japan | 271/180 |
| 431642 | 7/1992 | Japan . | |

*Primary Examiner*—Michael S. Huppert
*Assistant Examiner*—Scott L. Lowe
*Attorney, Agent, or Firm*—Welsh & Katz, Ltd.

[57] ABSTRACT

A bill processing unit in accordance with the present invention in which a drive section has a single motor, a driving force of the single motor causes a bill inserted through a bill insert slot to be transported within an interior of a body of the bill processing unit. The driving force of the single motor also causes a pushing device to be driven so that the transported bill is pushed down within a bill container to stack it in the bill container.

4 Claims, 11 Drawing Sheets

BILL PROCESSING UNIT

This is a continuation of application Ser. No. 08/147,328, filed Nov. 3, 1993, now abandoned.

BACKGROUND OF THE INVENTION

1. Field of the Invention

The present invention relates to a bill processing unit which is installed in a vending machine, a coin changing machine, a game machine, a play token machine or the like.

2. Description of the Related Art

In a machine for handling bills such as a vending machine, a bill processing unit is installed for discriminating genuine bills from false bills and accepting and accommodating genuine bills.

Such a bill processing unit is made up of a bill transporting section for transporting a bill inserted through a bill insert slot into the interior of the machine, a bill discriminating section for discriminating between genuine and false bills transported by the transporting section, a bill accommodating section including a bill container and a bill pushing mechanism for pushing the transported bills into the bill container to accumulate the bills therein, and a drive section for supplying driving forces to the bill pushing mechanism and the bill transporter.

In a conventional bill processing unit, the drive section has two motors: a first motor for driving the bill transporter and a second motor for driving the bill pushing mechanism. Since two motors are provided, the bill processing unit becomes complicated in structure, high in the manufacturing cost and large in size.

SUMMARY OF THE INVENTION

In view of the above circumstances, it is an object of the present invention to provide a bill processing unit which is compact in size and simple in structure.

In accordance with an aspect of the present invention, the above object is attained by providing a bill processing unit comprising a bill transporting section for transporting a bill inserted through a bill insert slot along a bill transportation path into an interior of a body of the bill processing unit; a bill discriminating section for judging whether the inserted bill is false or genuine; a bill accommodating section having a bill container and a pushing mechanism for pushing the transported bill into the bill container to stack the bill in the bill container; and a drive section for supplying driving forces to the bill transporting section and the pushing mechanism, wherein the drive section includes a single motor and power transmission mechanism for transmitting a rotational force of the motor both in forward and reverse directions to the bill transporting section and for transmitting the rotational force of the motor in one of the forward and reverse directions to the pushing mechanism.

According to the present invention, with the power transmission mechanism which transmits driving force of a single motor to the bill transporting section and the pushing mechanism, not only the number of necessary motors can be reduced by one and the structure of the bill processing unit can be correspondingly made simpler but also the bill processing unit can be made compact.

DESCRIPTION OF THE PREFERRED EMBODIMENTS

A bill processing unit in accordance with an embodiment of the present invention will be described.

Figure 1:
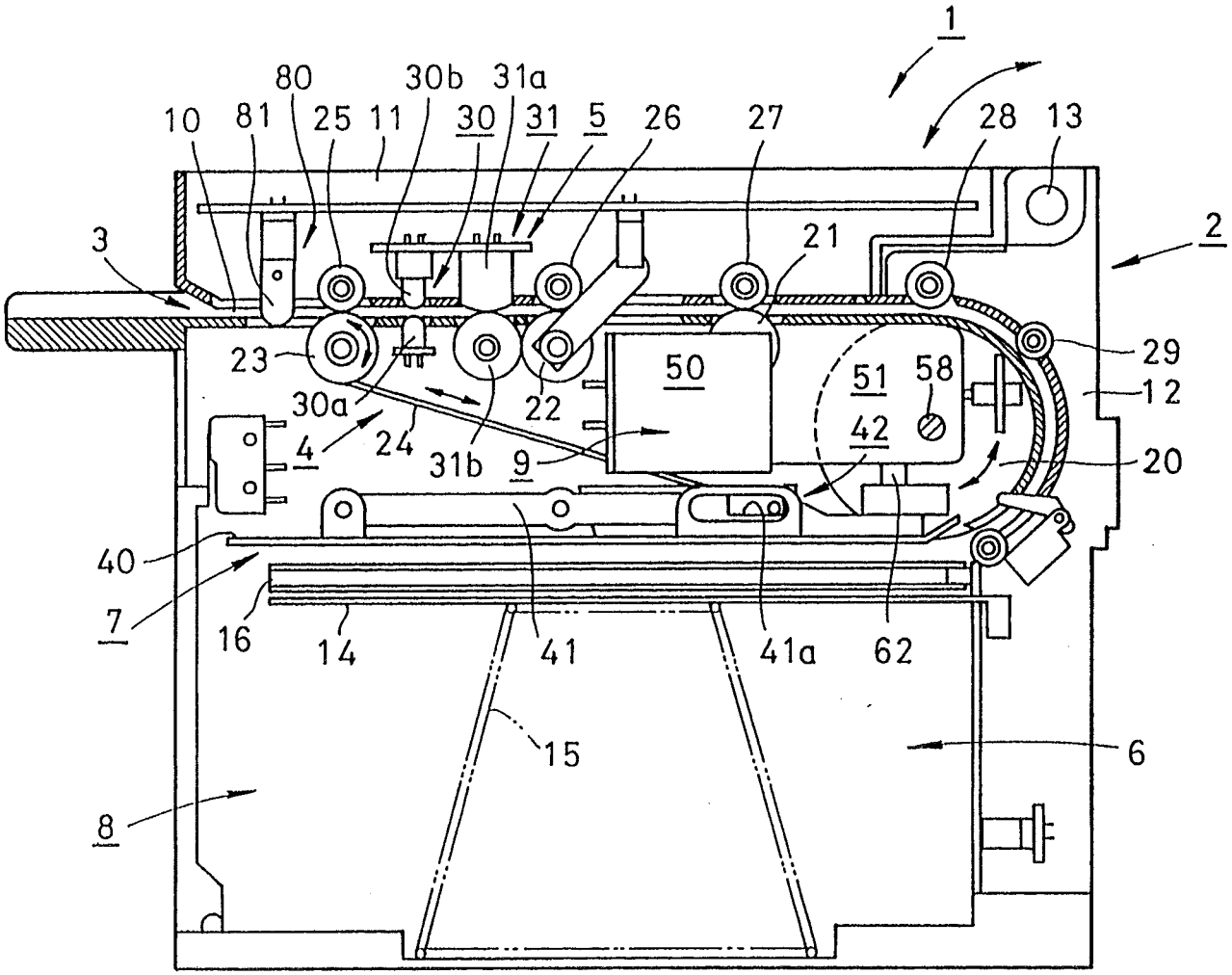
FIG. 1 schematically shows an arrangement of a bill processing unit in accordance with the present invention.

Referring to FIG. 1, the bill processing unit 1 includes a body of the bill processing unit 2. Disposed within the body of the bill processing unit 2 are a bill transporting section 4 in the form of a belt for transporting a bill inserted through a bill insert slot 3 into an interior of the body of the bill processing unit 2, a bill discriminating section 5 disposed in the bill transporting section 4 for discriminating genuine and false bills and determining whether the transported bill is false or genuine, a bill accommodation section 8 having a bill pushing mechanism 7 for pushing the bill fed through the bill transporting section 4 to accumulate the bill into a bill container 6, and a drive section 9 for supplying driving force to the bill transporting section 4 and the bill pushing mechanism 7, respectively.

The body of the bill processing unit 2 is made up of upper and lower covers 11 and 12 which are provided opposed to each other to define a bill transportation path 10 therebetween. The upper cover 11 is supported to the lower cover 12 to be opened and closed on a pivot 13. In the event of paper jamming or maintenance and/or inspection, the upper cover 11 rotates about the pivot 13 in the clockwise direction and the user can easily access to the bill transportation path 10 and can remove the jammed paper or conduct the maintenance and/or inspection.

In the lower part of the lower cover 12, there is provided the bill container 6 in which a stacker plate 14 for carrying bills thereon and a coil spring 15 for pushing up the stacker plate 14 from the bottom side.

Disposed also in the bill container 6 is a guide member 16 having a generally C-shaped section, so that, when the bill guided onto the upper surface of the guide member 16 is pushed down below the lower surface of the guide member 16 by the bill pushing mechanism 7, the bill is held between the lower surface of the guide member 16 and the upper surface of the stacker plate 14 and thus accommodated in the bill container 6.

The bill transporting section 4 includes a driving pulleys 20, 21, 22 and 23 disposed as partly exposed to an interior of the bill transportation path 10, a cocked belt 24 of a resilient material passed around the drive pulleys 20, 21, 22 and 23, and follower rollers 25, 26, 27, 28 and 29 disposed as contacted with the front surface of the cocked belt 24.

With the bill transporting section 4 having such a structure as described above, when the drive pulley 20 having a larger diameter compared with other drive pulleys rotates in the clockwise direction, the inserted bill is pulled into the interior of the body of the bill processing unit 2 and transported with the bill being kept between the cocked belt 24 and the follower rollers 25, 26, 27, 28 and 29.

The bill discriminating section 5 includes an optical sensor 30 for optically detecting the light and shade of the bill being passed along the bill transportation path 10 and a magnetic sensor 31 for detecting the magnetism of the bill. That is, whether the bill is false or genuine is determined by the output signals of the light and magnetic sensors 30 and 31. The optical sensor comprises light emitting and receiving elements 30*a* and 30*b* disposed in the upper and lower sides of the bill transportation path 10 as spaced by a predetermined distance therebetween. The magnetic sensor 31 comprises a magnetic head 31*a* and a pressure roller 31*b* mounted as pressed with the magnetic head 31*a*.

The bill pushing mechanism 7 of the bill accommodation section 8 includes a lift table 40 vertically moving up and down to push the bill guided on the upper surface of the guide member 16 down to the lower surface of the guide member 16, a link device 41 of a pantograph type with a hinge structure for vertically moving up and down with the parallelism of the lift table 40 being kept, and a slide device 42 engaged with a part 41*a* of the link device 41 for driving the link device 41.

Figure 2:
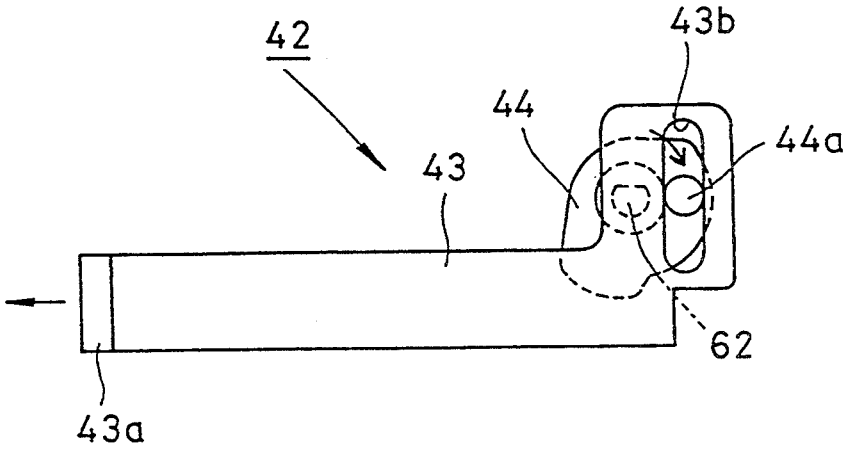
FIG. 2 is a bottom view of a slide device used in the bill processing unit.
Figure 3:
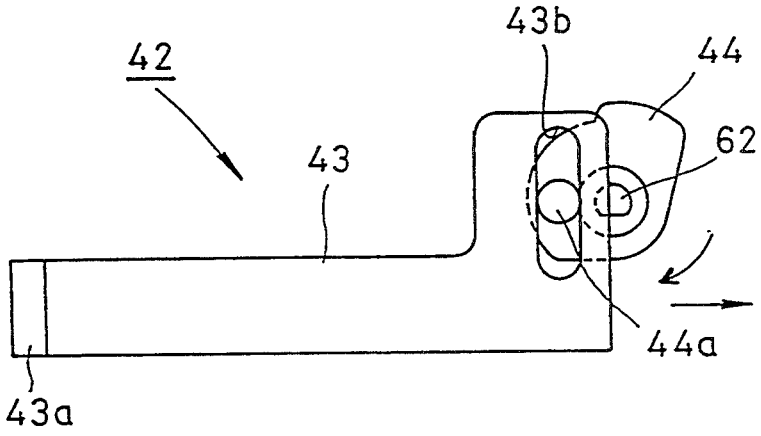
FIG. 3 is another bottom view of the slide device.

Referring to FIGS. 2 and 3, the slide device 42 comprises a slider 43 having a tilted surface 43*a* at its fore end and a guide slot 43*b* at its rear end, and a cam 44 having a pin 44*a* engaged in the guide slot 43*b*. When the cam 44 rotates on a stack output shaft 62 (which will be described later) by 90 degrees in one angular direction from an initial position of the slider 43 as shown in FIG. 2, the slider 43 moves forwardly as shown in FIG. 3. When the cam 44 is further rotated by 90 degrees in the same direction, the slider 43 is returned to the initial position. That is, in the slide device 42, one turn of the cam 44 causes the slider 43 to perform a reciprocating movement from the initial position of FIG. 2 through the forwardly moved position of FIG. 3 again to the initial position of FIG. 2.

The drive section 9 for transmitting driving forces to the bill transporting section 4 and bill pushing mechanism 7 will now be described.

Figure 4:
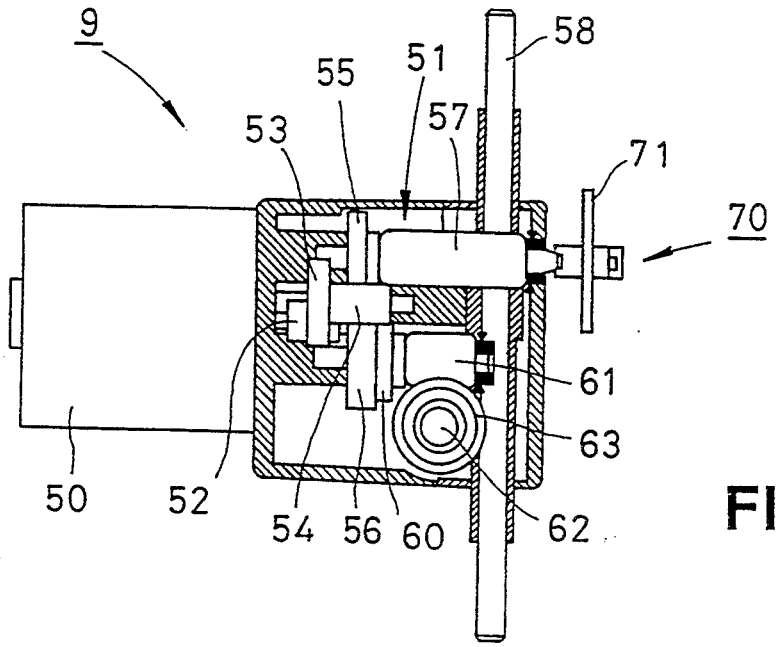
FIG. 4 is a cross-sectional view of a drive section used in the bill processing unit of the present invention.
Figure 5:
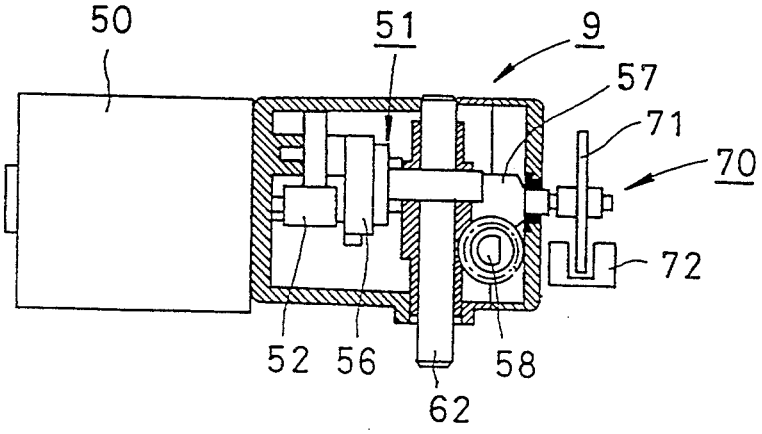
FIG. 5 is another cross-sectional view of the drive section.
Figure 6:
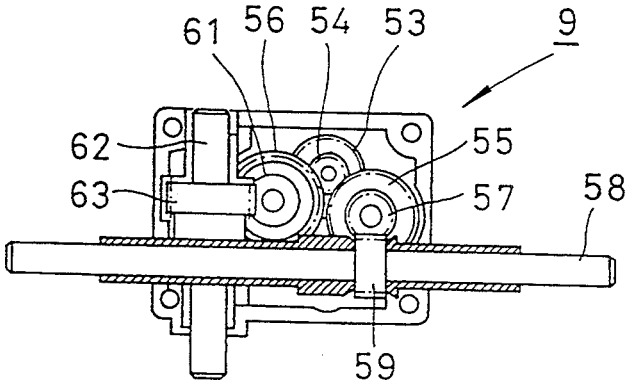
FIG. 6 is a still another cross-sectional view of the drive section.

Referring to FIGS. 4 through 6, which are cross-sectional views of major parts of the drive section 9, the drive section 9 includes a single motor 50 and a power transmission mechanism 51 disposed within a casing for transmitting a torque of the motor 50.

The power transmission mechanism 51 has a pinion 52 fixedly mounted to an output shaft of the motor 50, a gear 53 constantly engaged with the pinion 52, a pinion 54 fixed to the gear 53, and first and second follower gears 55 and 56 constantly engaged with the pinion 54. The first follower gear 55 is fixedly mounted to a worm gear 57 which in turn is engaged to a worm wheel 59 at all times as shown in FIG. 6. The worm wheel 59 is fixedly mounted to a transportation output shaft 58 for rotating the large-diameter drive pulley 20 in the bill transporting section 4 (FIG. 1).

With the drive section 9 having a structure as described above, the transportation output shaft 58 for rotating the drive pulley 20 of the bill transporting section 4 can be rotated following up the rotation of the motor 50 both in the forward and reverse directions. When the motor 50 turns in the forward direction, the transportation output shaft 58 rotates in the forward direction, and vice versa.

Disposed inside the second follower gear 56 meshed with the pinion 54 of the power transmission mechanism 51 is a one-way clutch 60 as shown in FIG. 4, through which the second follower gear 56 is connected with a worm gear 61. The worm gear 61 in turn is engaged with a worm wheel 63 which is fixedly mounted onto a stack output shaft 62 for rotating the cam 44 of the slide device 42 shown in FIG. 2.

With the drive section 9 having such a structure as described above, when the motor 50 turns in the reverse direction, the stack output shaft 62 for rotating the cam 44 of the slide device 42 in FIG. 2 receives power from the motor and is rotated under the action of the one-way clutch 60, while, when the motor 50 turns in the forward direction, the stack output shaft 62 fails to receive the power and thus the rotation of the shaft 62 is stopped.

An encoder 70 for detecting a rotation of the worm gear 57 for rotating the transportation output shaft 58 is made up of a rotary disk 71 fixedly mounted to the worm gear 57 and a photosensor 72 for detecting a rotation of the rotary disk 71.

Description will next be made as to the operation of the bill processing unit 1 and the structure thereof.

Figure 7:
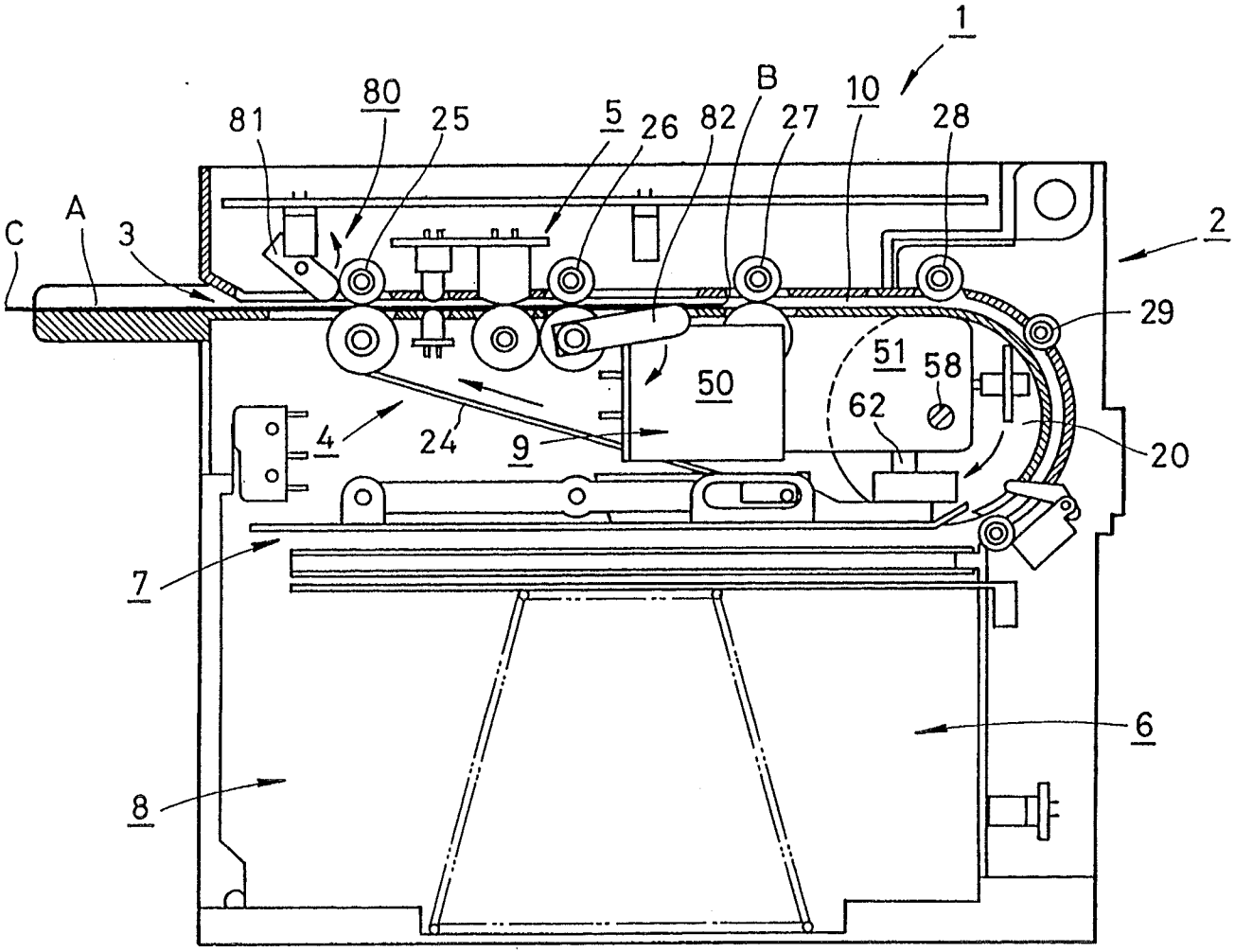
FIGS. 7 to 14 are diagrams for explaining the operation of the bill processing unit of the invention.

When a bill A is inserted into the bill insert slot 3 of the bill processing unit 1, this causes a lever 81 of an inlet sensor 80 disposed adjacent to the bill insert slot 3 to be pivoted on its pivot in a counterclockwise direction, whereby the inserted bill A is detected. As shown in FIG. 7, the motor 50 of the drive section 9 rotates in the forward direction on the basis of a bill detection signal issued from the inlet sensor 80, so that the transportation output shaft 58 of the bill transporting section 4 rotates clockwise to drive the drive pulley 20.

This causes the bill A to be held between the cocked belt 24 and the follower rollers 25, 26, 27, 28 and 29 and then transported along the bill transportation path 10 within the body of the bill processing unit 2.

Although the motor 50 rotates and the transportation output shaft 58 of the bill transporting section 4 is rotated in the clockwise direction, the stack output shaft 62 for driving the bill pushing mechanism 7 is not rotated because of the action of the one-way clutch 60 (see FIG. 4) disposed in the power transmission mechanism 51 of the drive section 9. Thus, the bill pushing mechanism 7 stops its operation and is placed in an initial position as shown in FIG. 7, i.e., in the wait mode.

Figure 8:
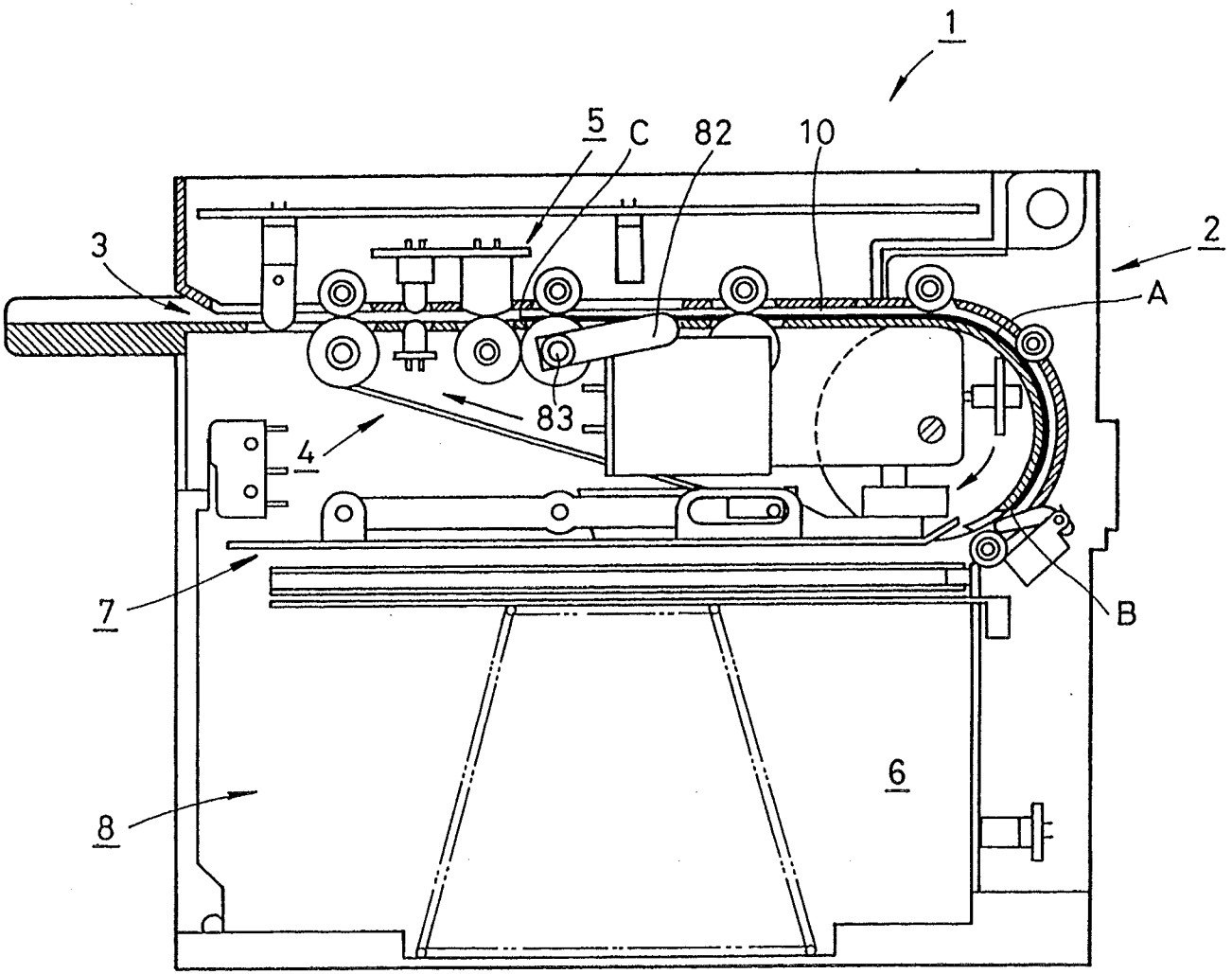

Whether the inserted bill A is false or genuine is determined on the basis of a detection signal of the bill discriminating section 5 during a period from the time when the bill A is fed inside through a pulling-out prevention lever 82 pivoted in the clockwise direction for pulling in a tip end B of the paper A as shown in FIG. 7, until a trailing end C of the bill A reaches a shaft 82*c* of the pulling-out prevention lever 82 as shown in FIG. 8.

When the bill discriminating section 5 determines that the bill A is genuine at a transportation position of the bill A as shown in FIG. 8, the genuine bill A is further transported to the downstream of the bill transportation path 10 by the bill discriminating section 5. When the tip end B of the bill A is guided to a position between the lift table 40 of the bill pushing mechanism 7 and the upper surface of the guide member 16 as shown in FIG. 9, the trailing end C of the bill A moves to a position upstream of the pulling-out prevention lever 82.

Figure 9:
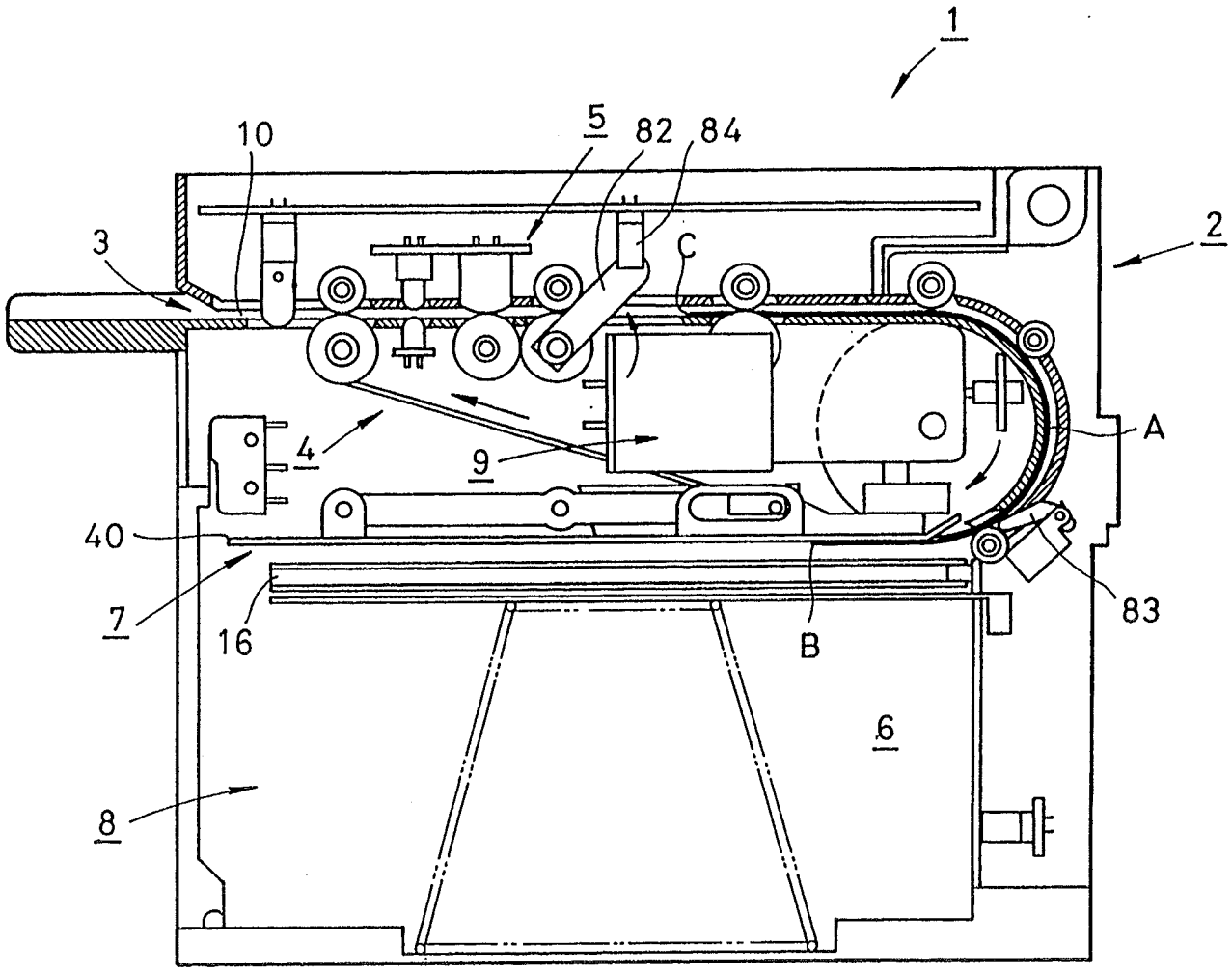

As a result, when the trailing end C of the bill A arrives at such a transportation position as shown in FIG. 9, the pulling-out prevention lever 82 is rotated in the counterclockwise direction under the influence of a resilient restoring force of a spring (not shown) and is returned to such an initial position that blocks the bill transportation path 10, which results in that the user cannot pull out the bill A from such a transportation position of the bill A as shown in FIG. 9.

In FIG. 9, a bill pass lever 83 is used to detect the passage of the bill. More specifically, the presence or absence of the bill at the bill pass lever 83 is detected by the tilting motion of the bill pass lever 83. A sensor 84 detects the tilting motion of the pulling-out prevention lever 82 and the return thereof to its initial position.

Figure 10:
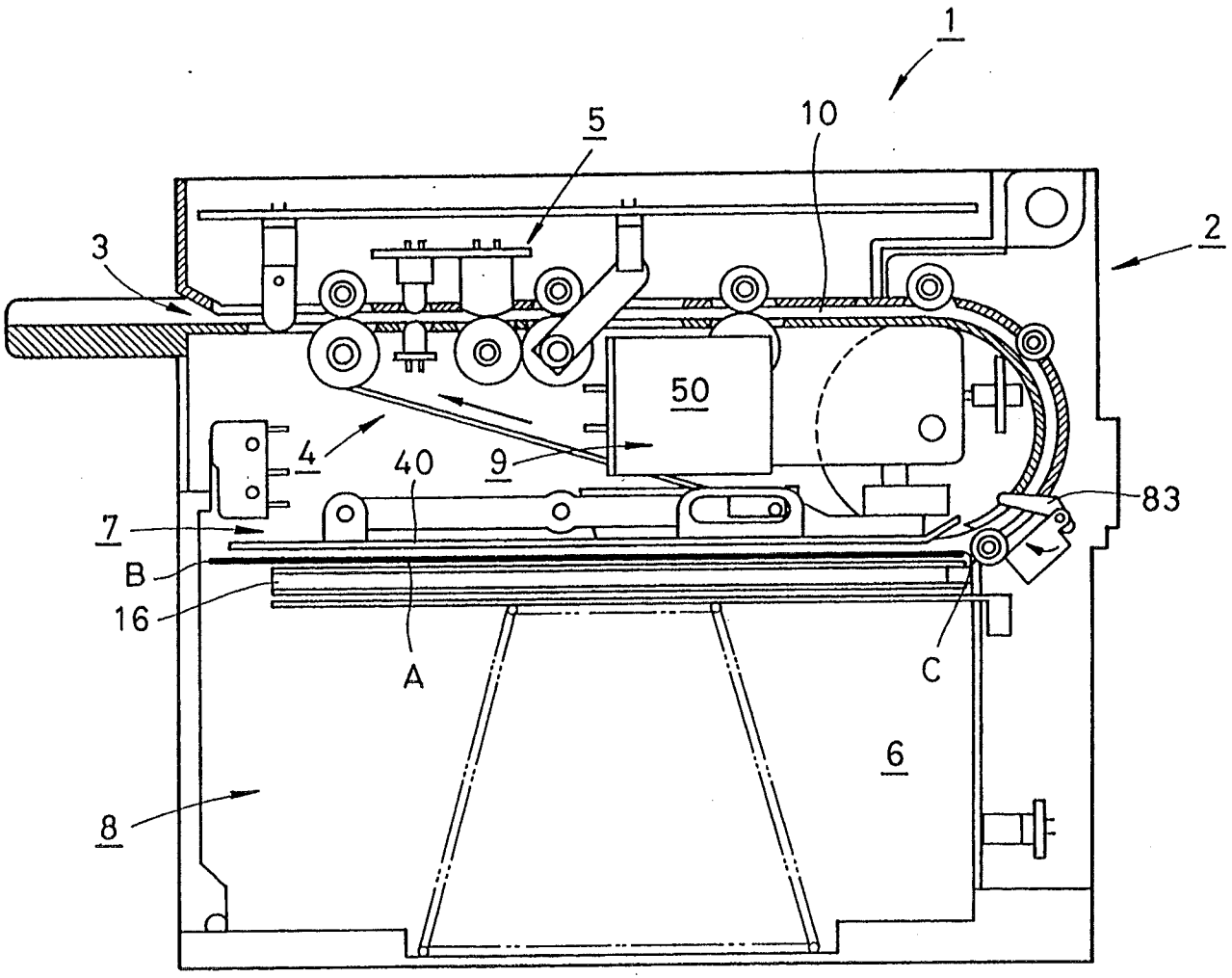

When the bill A further moves from the position of FIG. 9 by the bill transporting section 4, the trailing end C of the bill A is guided to a position between the lift table 40 of the bill pushing mechanism 7 and the upper surface of the guide member 16 as shown in FIG. 10, at which position the bill pass lever 83 positioned at the termination end of the bill transportation path 10 is returned to its initial position, whereby it can be detected that the tip and trailing ends B and C of the bill A are guided to positions between the lift table 40 of the bill pushing mechanism 7 and the upper surface of the guide member 16.

Figure 11:
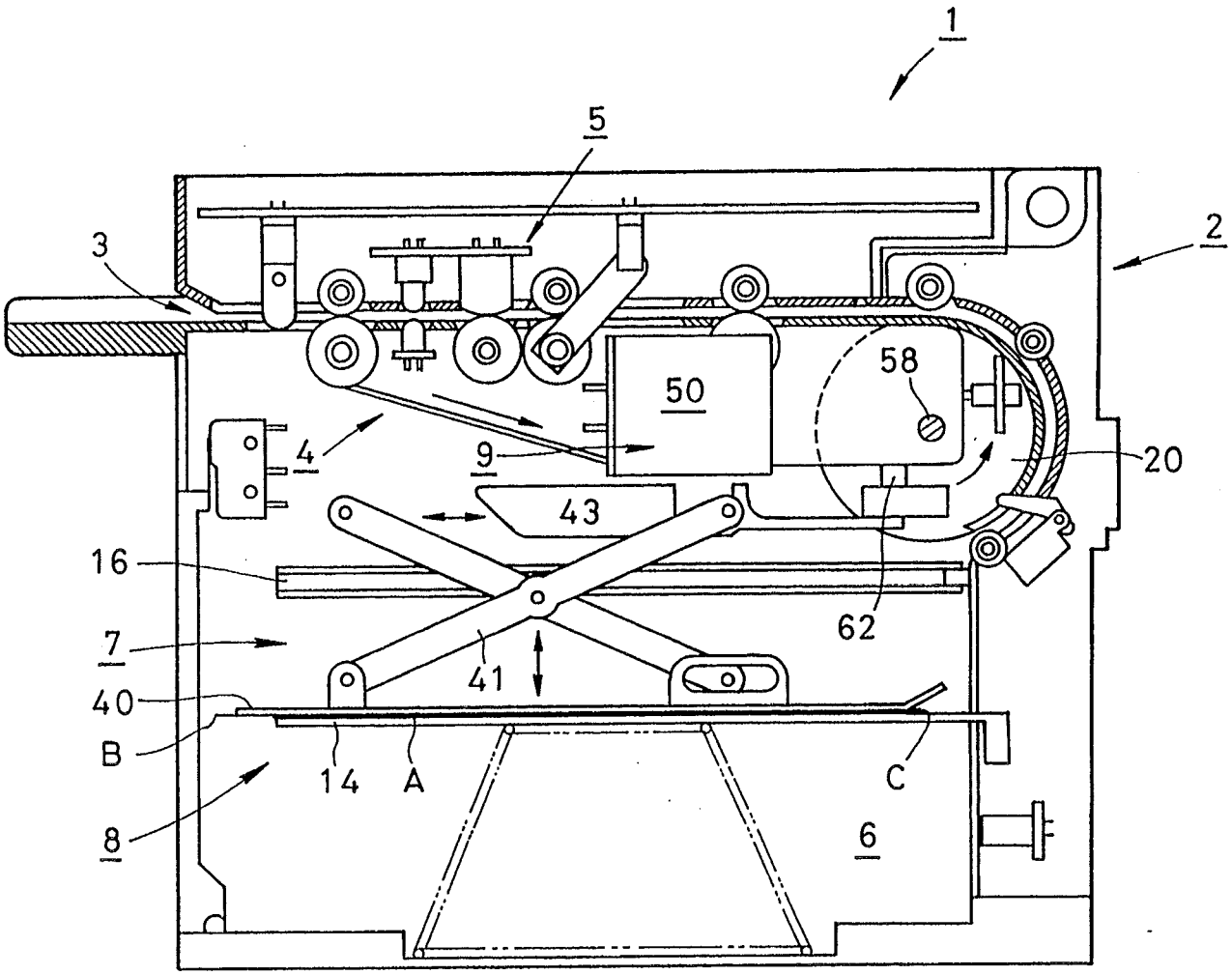
Figure 12:
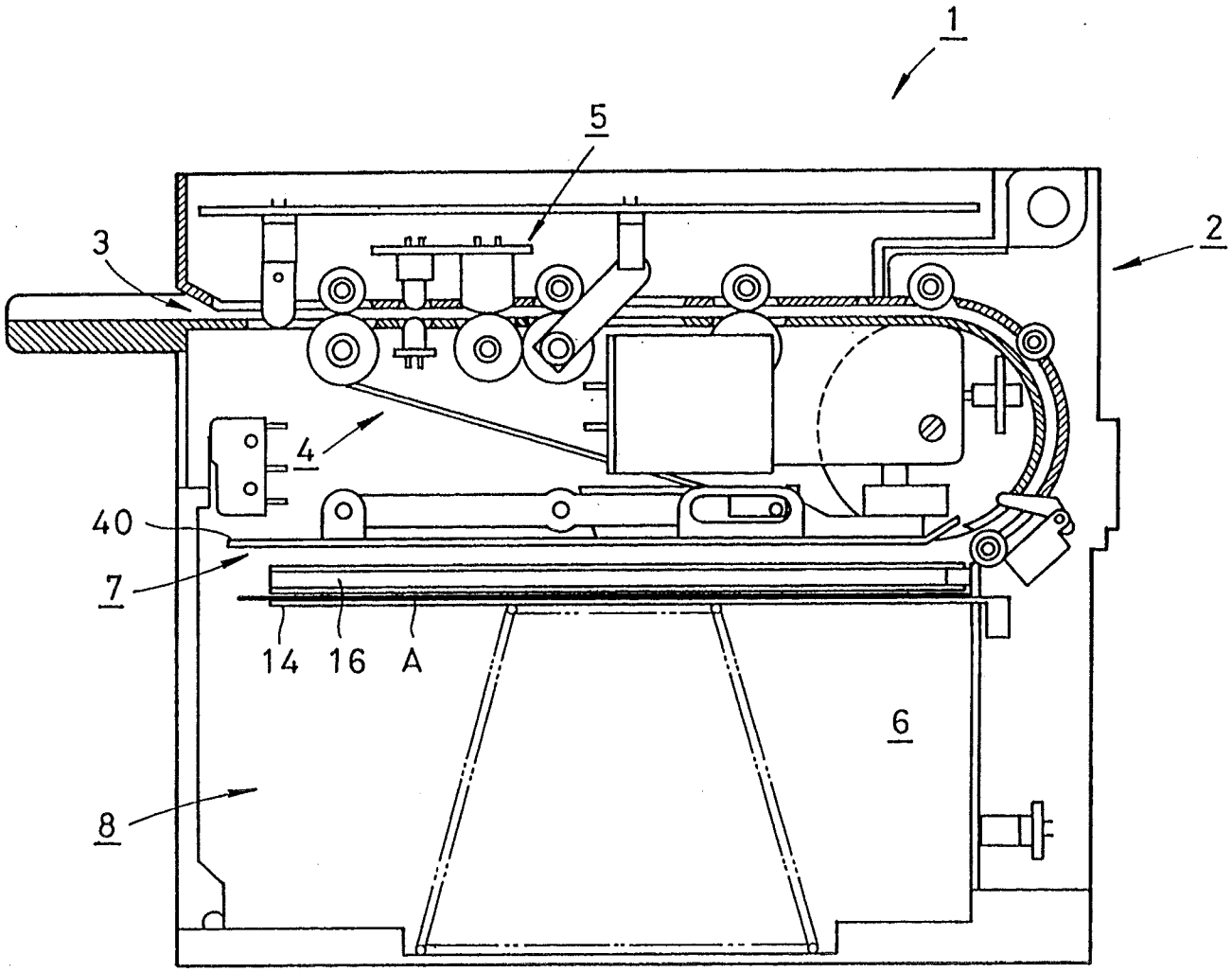

When it is detected that the trailing end C of the bill A was passed through the position of the bill pass lever 83 by the detection signal generated when the bill pass lever 83 returns to its initial position and the bill A was guided to the position between the lift table 40 of the bill pushing mechanism 7 and the upper surface of the guide member 16, the motor 50 of the drive section 9 is rotated in the reverse direction on the basis of the detection signal. Then, as shown in FIG. 11, the transportation output shaft 58 of the bill transporting section 4 is reversely rotated to drive the drive pulley 20 in the counterclockwise direction. At the same time, a driving force of the reversely motor 50 is transmitted to the stack output shaft 62 through the one-way clutch 60 (see FIG. 4) to thereby rotate the stack output shaft 62 by one turn. Since one turn of the stack output shaft 62 causes one turn of the cam 44 of the slide device 42 as shown in FIGS. 2 and 3, the slider 43 performs the reciprocating movement, that is, starting from the initial position of FIG. 2, shifting to the forwardly moved position of FIG. 3 and then returning to the initial position of FIG. 2. Accordingly, as shown in FIG. 11, the link device 41 of the pantograph structure to be vertically moved up or down is driven and moved downward toward the lift table 40 with the lift table 40 kept parallel, so that the lift table 40 pushes the bill A guided on the upper surface of the guide member 16 against the lower surface of the guide member 16. And as shown in FIG. 12, when the lift table 40 is returned to the initial position, the pushed-down bill A is kept between the lower surface of the guide member 16 and the upper surface of the stacker plate 14, that is, the bill is accommodated within the bill container 6.

Figure 13:
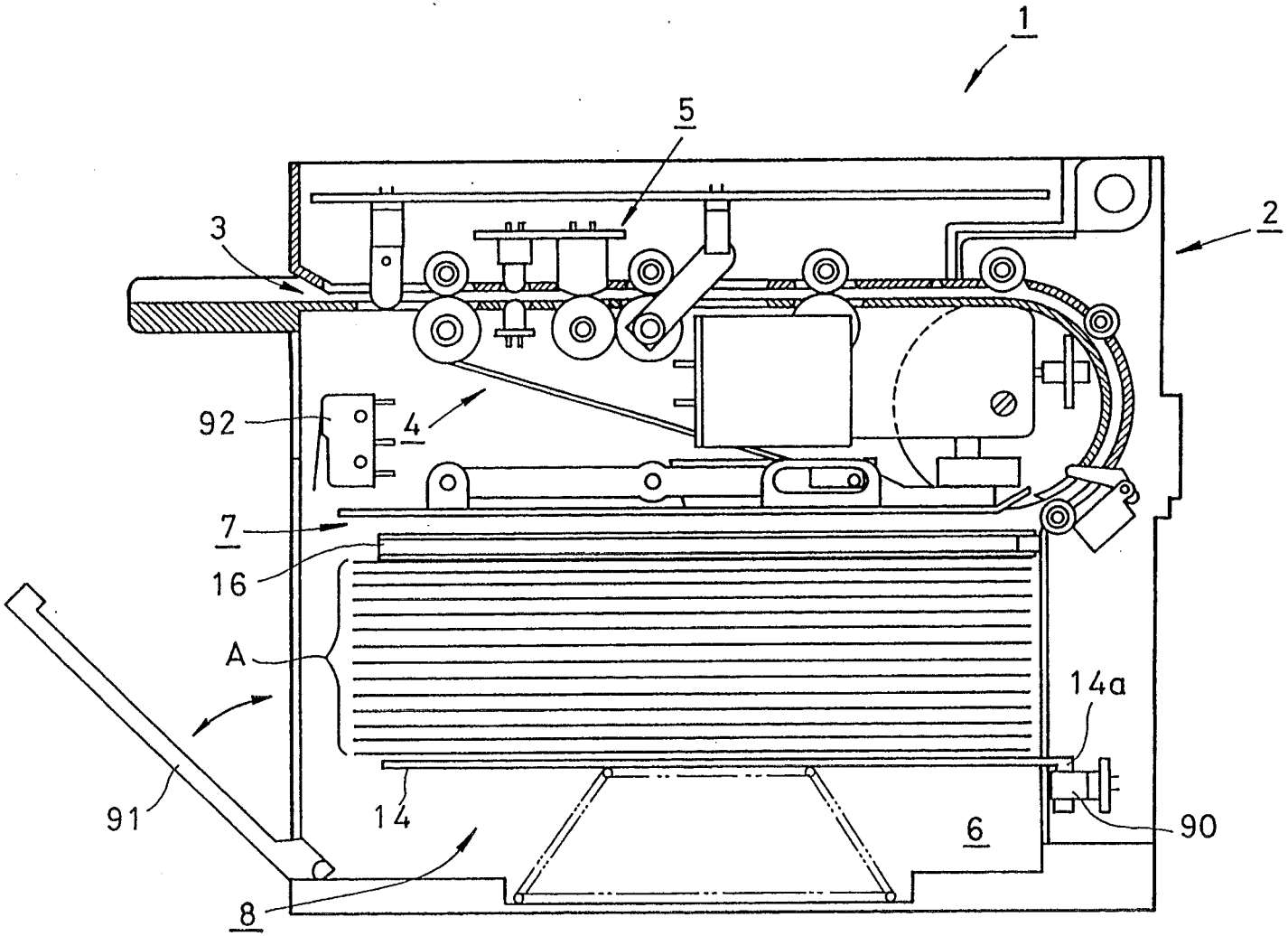

After the genuine bills A are successively stacked within the bill container 6 according to the above-described procedure, when the thickness of the stacked bills causes the stacker plate 14 to be moved downward until a tongue piece 14*a* provided to an end of the stacker plate 14 is inserted into a fully-stacked-state sensor 90 as shown in FIG. 13, the sensor 90 can detect a state that the bills are fully stacked in the bill container 6.

When the bill container 6 becomes full, a money collection cover 91 is opened from the front side of the bill container 6 to collect the bills A in the bill container 6. In FIG. 13, a switch 92 detects whether the bill collection cover 91 is opened or closed.

Figure 14:
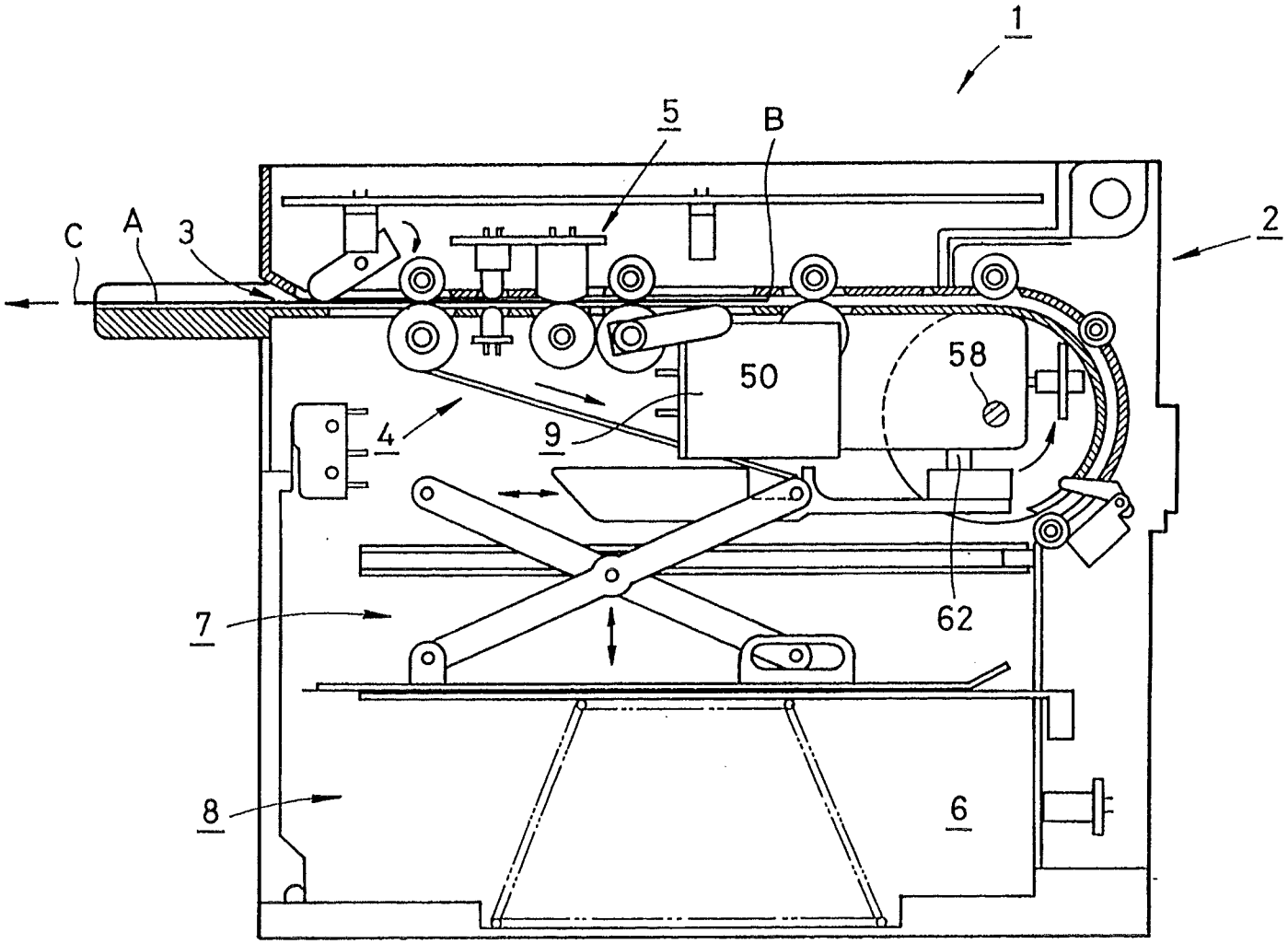

During the period when the tip end B of the bill A transported along the bill transportation path 10 is further transported while the pulling-out prevention lever 82 rotate clockwise as shown in FIG. 7, and the trailing end C of the bill A reaches the shaft 82*c* of the pulling-out prevention lever 82 as shown in FIG. 8, the bill discriminating section 5 determines whether the inserted bill A is false or genuine. When the bill discriminating section 5 determines that the bill A is false and outputs a decision signal issued from the bill discriminating section 5 causes the motor 50 of the drive section 9 to be reversely rotated as shown in FIG. 14, so that the transportation output shaft 58 of the bill transporting section 4 is rotated counterclockwise to return the false-determined bill A from the bill insert slot 3. At this time, since the motor 50 is reversely driven, its torque is transmitted also to the stack output shaft 62 through the one-way clutch 60 (see FIG. 4), whereby the bill pushing mechanism 7 of the bill accommodation section 8 is driven to carry out the stack operation.

As has been explained in the foregoing, in accordance with the bill processing unit of the present invention, since the power transmission mechanism for transmitting the driving force of the single motor to the bill transporting section and the bill pushing mechanism respectively is provided to thereby drive both the bill transporting section and bill pushing mechanism with use of the single motor, there can be provided a bill processing unit in which the number of motors can be decreased, a structure can be correspondingly simplified with an inexpensive manufacturing cost, and thus the size of the bill processing unit can be made compact by an amount corresponding to the decreased number of motors.

The present invention can be modified in various ways without departing from the spirit and major features of the present invention. Accordingly, it will be appreciated that the foregoing embodiment has been given merely as an example and thus the invention is restricted not to the specific embodiment and the body of the present specification but to the scope of the attached claims, and that the present invention covers all other possible modifications, alternations and equivalent arrangements within the scope of the appended claims.

What is claimed is:

1. A bill processing unit comprising:

bill transporting means for transporting a bill inserted through a bill insert slot along a bill transportation path;

bill discriminating means provided in the bill transportation path, for judging whether the bill being transported along the bill transportation path is genuine or false;

a guide member disposed at a downstream end of the bill transportation path and having an upper surface, for temporarily holding the bill transported by the bill transporting means on the upper surface;

a stacker plate normally biased toward a lower surface of the guide member by means of a coil spring;

pushing means including a link device of a pantograph structure pivotably connected to a lift table at a lower end thereof, the link device capable of moving the lift table in a vertical direction with a surface of the lift table being kept horizontal, and a slider having a fore end portion to which an upper end of the link device is engaged and a rear end portion where a guide hole is formed, the reciprocal movement of the slider in the horizontal direction causing the lift table to move in the vertical direction, a bill temporarily held on the upper surface of the guide member being pushed down below the lower surface of the guide member by the vertical movement of the lift table; and a drive means including a cam formed with a pin which engages with the guide hole of the slider, one revolution of the cam causing reciprocal movement of the slider, a single motor, and a one-way clutch for transmitting the rotational force of the single motor in both clockwise and anti-clockwise directions to the bill transporting means and for transmitting the rotational force of the single motor in only one of the clockwise and anti-clockwise directions to the cam, the revolution of the single motor in one direction causing a bill on the bill transporting means to be transported to the upper surface of the guide member and the revolution of the single motor in another direction causing the horizontal reciprocating movement of the slide through the cam.

2. A bill processing unit as set forth in claim 1, wherein the bill transporting means includes:

a plurality of drive pulleys disposed as partially exposed to the bill transportation path;

a cocked belt of a resilient material winding around the plurality of drive pulleys; and a plurality of follower rollers disposed as pressed with a surface of the cocked belt.

3. A bill processing unit as set forth in claim 1, wherein the bill discriminating means includes an optical sensor for detecting light and shade of a bill passed along the bill transportation path and a magnetic sensor for detecting magnetism of the bill.

4. A bill processing unit comprising:

a bill transportation path along which a bill, inserted into a bill insert slot provided upstream of the bill transportation path, is transported, the bill transportation path being curved in a downstream portion so that the bill is guided below a body of the bill processing unit;

bill transporting means for transporting a bill inserted into the bill insert slot along the bill transportation path;

bill discriminating means provided in the bill transportation path, for judging whether the bill being transported along the bill transportation path is genuine or false;

a stacker provided below the body of the bill processing unit and including a guide member disposed at a downstream end of the bill transportation path and having an upper surface, for temporarily holding the bill transported by the bill transporting means on the upper surface, and a stacker plate normally biased toward a lower surface of the guide member by means of a coil spring, the stacker accommodating the bill transported along the bill transportation path in such a manner that the bill is held between the lower surface of the guide member and the stacker plate;

pushing means including a link device of a pantograph structure pivotably connected to a lift table at a lower end thereof, the link device capable of moving the lift table in a vertical direction with a surface of the lift table being kept horizontal, and a slider having a fore end portion to which an upper end of the link device is engaged and a rear end portion where a guide hole is formed, the reciprocal movement of the slider in the horizontal direction causing the lift table to move in the vertical direction, a bill temporarily held on the upper surface of the guide member being pushed down below the lower surface of the guide member by the vertical movement of the lift table; and drive means including a cam formed with a pin which engages with the guide hole of the slider, one revolution of the cam causing reciprocal movement of the slider, a single motor, and a one-way clutch for transmitting the rotational force of the single motor in both clockwise and anti-clockwise directions to the bill transporting means and for transmitting the rotational force of the single motor in only one of the clockwise and anti-clockwise directions to the cam, the revolution of the single motor in one direction causing a bill on the bill transporting means to be transported to the upper surface of the guide member and the revolution of the single motor in another direction causing the horizontal reciprocating movement of the slide through the cam.

* * * * *